US005506004A

United States Patent [19]

Maruoka et al.

[11] Patent Number: 5,506,004

[45] Date of Patent: Apr. 9, 1996

[54] METHOD FOR COATING GOLF BALLS

[75] Inventors: Kiyoto Maruoka, Kobe; Yoshikazu Yabuki, Akashi; Kuniyasu Horiuchi, Kobe; Masatoshi Takahashi, Settsu, all of Japan

[73] Assignee: Sumitomo Rubber Industries, Ltd., Hyogo, Japan

[21] Appl. No.: 365,112

[22] Filed: Dec. 28, 1994

[30] Foreign Application Priority Data

Dec. 29, 1993 [JP] Japan ..... 5-351590

[51] Int. Cl.[6] ..... B05D 1/02; A63B 37/12

[52] U.S. Cl. ..... 427/425; 427/424; 427/421; 273/235 A

[58] Field of Search ..... 427/425, 424, 427/421; 273/235 A

[56] References Cited

U.S. PATENT DOCUMENTS

| | | | |
|---|---|---|---|
| 4,704,298 | 11/1987 | Herman et al. | 427/453 |
| 4,802,674 | 2/1989 | Kitaoh | 273/235 A |
| 4,871,589 | 10/1989 | Kitaoh et al. | 427/322 |

FOREIGN PATENT DOCUMENTS

| | | |
|---|---|---|
| 0601861 | 6/1994 | European Pat. Off. . |
| 1-293155 | 11/1989 | Japan . |

OTHER PUBLICATIONS

Patent Abstracts of Japan; vol. 14, No. 74; Feb. 13, 1990 JP1293155; Nov. 27, 1989; Asahi Okuma Ind., Co., Ltd.

*Primary Examiner*—Roy V. King
*Attorney, Agent, or Firm*—Birch, Stewart, Kolasch & Birch

[57] ABSTRACT

Disclosed is a method for coating a golf ball, wherein the coating efficiency of the paint is high and a uniform coating can be formed. According to the method, the paint is sprayed on a golf ball moving with rotation on the circumference of a circle having a diameter of 0.5 to 1.5 m from a disc charged with 60,000 to 130,000 V, which is rotating at 20,000 to 40,000 rpm and is inclined or moving in the vertical direction, or a paint is sprayed in a direction at an angle of 45° or less to the horizontal direction from a disc charged with the above voltage, which is rotating at the above number of revolutions, to coat the golf ball so that a ratio of the maximum film thickness to the minimum film thickness may be 1.5 or less after one round of coating.

11 Claims, 1 Drawing Sheet

METHOD FOR COATING GOLF BALLS

FIELD OF THE INVENTION

The present invention relates to a method for coating a golf ball with paint. More particularly, it relates to a method for coating a golf ball with paint, wherein the coating efficiency of the paint is high and the resulting coating is uniform in thickness.

BACKGROUND OF THE INVENTION

In order to make appearance of golf balls beautiful and to prevent stain from adhering to the surface of the golf ball, the surface of the golf ball is coated with enamel and clear paint or coated only with clear paint.

As a method capable of coating the golf ball with enamel paint or clear paint by one coating, an air gun coating has hitherto been used. According to the air gun coating, the whole golf ball can be coated with a paint by moving the air gun vertically.

However, the air gun coating process has the problem that the coated film is not uniform, which results in a deterioration of appearance.

Further, in a disc type electrostatic coating wherein paint is coated on an article to be coated from a front direction, there can be used a method capable of coating with enamel paint or clear paint by a single coating. In this electrostatic coating, since the golf ball has no electric conductivity, a conductive agent obtained by diluting a quaternary ammonium salt with alcohol is applied on the surface of the golf ball and, after drying, the golf ball is grounded by placing thereon three metal needles to impart electroconductivity to the golf ball. After the golf ball is subjected to the above electroconducting treatment, a charged paint is sprayed on the surface of the golf ball to give a golf ball which has been coated uniformly. However, according to this method, a satisfactory coating can be formed on an article having a relatively large area, but the coating efficiency is inferior for an article having a relatively small area such as a golf ball, and thus at least twice as much paint is required in comparison with the air gun system.

Further, there is also suggested a coating method comprising spraying a charged paint over a golf ball moving on the circumference of a circle from the center part of an electrostatic coater.

However, according to this method, the charged paint is attracted to metal needles supporting the golf ball and, therefore, the lower half of the golf ball is hardly coated. Accordingly, in order to coat the whole golf ball uniformly, the golf ball must be turned over after moving around on the circumference of the circle and moved on the circumference of the circle one more time. Thus, the coating efficiency was good but producibility is low.

As described above, the conventional method for coating a golf ball has the problem that a coated film is not formed uniformly and the coating efficiency of the paint is inferior. Further, methods having good coating efficiency lack in producibility.

OBJECTS OF THE INVENTION

The main object of the present invention is to provide a method for coating a golf ball wherein an uniform coating can be formed and the coating efficiency of the paint is good and, furthermore, the producibility is also good.

This object as well as other objects and advantages of the present invention will become apparent to those skilled in the art from the following description with reference to the accompanying drawing.

SUMMARY OF THE INVENTION

Figure 1:
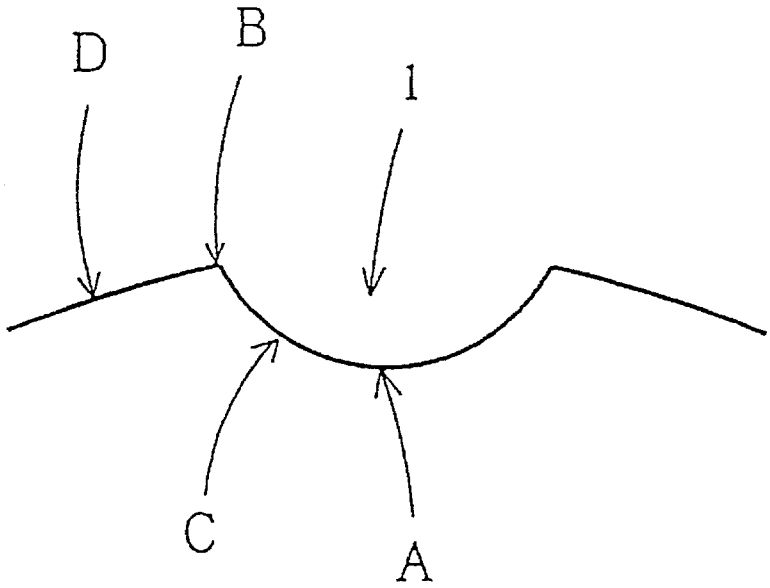
FIG. 1 is a schematic diagram illustrating the surface part of the golf ball.

The present invention provides a method for coating a golf ball, which comprises spraying a charged paint according to a specific embodiment over a golf ball moving with rotation on the circumference of a circle from a disc of an electrostatic coater to provide a coating of an uniform film thickness with good coating efficiency after one round of coating.

DETAILED DESCRIPTION OF THE INVENTION

It is necessary that the diameter of a circle wherein the golf ball moves with rotation on the circumference of the circle is 0.5 to 1.5 m, preferably 0.7 to 1.1 m. That is, good coating properties (uniform coat-forming properties) and high coating efficiency are accomplished by setting the diameter of the circle within a range of 0.5 to 1.5 m. When the diameter of the circle is smaller than the above range, since the paint does not adhere to the golf ball, it becomes difficult to obtain an uniform coating. On the other hand, when the diameter of the circle is larger than the above range, the coating efficiency deteriorates.

It is necessary that the disc for spraying the paint is rotating at 20,000 to 40,000 rpm, preferably 25,000 to 35,000 rpm. That is, good coating properties can be obtained by rotating the disc at the number of revolutions within the above range. When the number of revolutions of the disc is smaller than the above range, particles of the paint become large, which results in irregular coating. On the other hand, when the number of revolutions of the disc is larger than the above range, particles of the paint become too small and the paint can not reach the golf ball easily, which results in irregular coating.

Further, it is necessary that the charge to be applied on the disc is 60,000 to 130,000 V, preferably 80,000 to 100,000 V. That is, good coating properties can be obtained by setting the charge to be applied on the disc within the above range. When the charge to be applied on the disc is smaller than the above range, the coating efficiency deteriorates. On the other hand, when the charge to be applied on the disc is larger than the above range, the problem of safety arises and the consumption of power becomes large, thereby increasing the coating cost.

It is preferred that the diameter of the disc is 200 mm or less, particularly 50 to 150 mm. When the diameter of the disc is within the above range, the disc can be easily revolved at the above number of revolutions. Further, by connecting a body of the electrostatic coater with the disc via an air bearing, the disc can be revolved at the above number of revolutions more stably.

In order to obtain an uniform coating by one round coating, it is preferred that the disc is inclined in addition to the above condition. That is, by inclining the disc, the region to be sprayed with the paint can be widen and it becomes possible to coat the whole golf ball uniformly. It is preferred that the disc is inclined at an angle of 3° to 15° to a horizontal direction. When the angle to the horizontal direction of the disc is smaller than the above range, the region to be sprayed with the paint can not be widened. On the other hand, when the angle to the horizontal direction of the disc is larger than the above range, the region to be sprayed with the paint is too wide, which results in deterioration in the coating efficiency and generation of irregular coating.

As a means to obtain an uniform coating by one round coating, it is preferred to move the disc vertically in addition to a means to incline the disc. That is, by moving the disc vertically, the region to be sprayed with the paint can be widen and it becomes possible to coat the whole golf ball uniformly. Further, the moving distance at the time of moving the disc in the vertical direction is, as shown in the Examples described hereinafter, within a range between a position which is 30 cm away from the position of the golf ball in the up direction and a position which is 10 cm away from the position of the golf ball in the down direction, the position of the golf ball being 0.

As a matter of course, it is preferred to use the above two means in combination, that is, the disc is inclined and, at the same time, the disc is moved in the vertical direction, in order to obtain an uniform coating by one round coating.

Further, by changing the shape of the disc, the direction for spraying the paint can be changed. Preferable results can be obtained by changing the shape of the disc and changing the direction for spraying the paint to a downward direction at an angle of 45° or less to the horizontal line, and more preferable results can be obtained by changing the direction for spraying the paint in a downward direction at an angle of 10° to 20° to the horizontal direction. In that case, the direction for spraying the paint may be in an upward direction to the horizontal direction and the upward angle is up to about 20° to the horizontal direction. That is, the direction for spraying the paint is within a range of 45° in the downward direction and 20° in the upward direction. More preferably results can be obtained when it is within a range of 10° to 20° to the horizontal direction.

It is preferred that the electroconductivity is imparted in advance to the golf ball to be coated by coating it with a solution obtained by diluting a quaternary ammonium salt with alcohols, having a concentration of about 1 to 2% by weight. Further, it is preferred that the golf ball is placed on three metal needles grounded at the time of coating.

In order to obtain a uniform coating, it is preferred that the golf ball is rotating at 30 to 100 rpm at the time of coating. When the golf ball is rotating at the above number of revolutions, it becomes possible to coat the golf ball uniformly.

Examples of the paint to be used for coating include urethane and epoxy paints, but the paint is not specifically limited.

In the present invention, there can be formed a coating which has good coating efficiency and high uniformity, i.e. the ratio of the maximum film thickness to the minimum film thickness is 1.5 or less, by means of the charge, the number of revolutions of the disc, the rotation of the golf ball, the inclination or vertical movement of the disc, etc.

The golf ball is normally coated in a film thickness of 7 to 60 μm. The present invention exhibits remarkable technical effects, particularly in the formation of the coating having a thickness within the above range.

As described above, according to the present invention, there can be formed a uniform coating having good coating efficiency of paint on the golf ball. That is, the coating efficiency can reach a high level which is about two times that of the conventional air gun coating, and uniformity of the coating is high, i.e. a ratio of the maximum film thickness to the minimum film thickness is 1.5 or less.

Further, according to the present invention, the coating can be completed only by moving the golf ball around the whole circumference of the circle and the producibility of the golf ball is also high.

EXAMPLES

The following Examples and Comparative Examples further illustrate the present invention in detail but are not to be construed to limit the scope thereof.

Examples 1 to 15 and Comparative Examples 1 to 8

A paint was coated on the surface of the golf ball according to the following manner and the resulting coating was evaluated.

1. Golf ball to be coated

A two-piece solid golf ball was obtained by providing a solid core, which was obtained by subjecting a rubber composition to a vulcanizing molding, with a cover composed of an ionomer resin as a main material, the surface of the golf ball being provided with 432 dimples.

2. Coating system

Two systems such as electrostatic coating, and air gun coating were utilized as a comparison. That is, the electrostatic coating is conducted in Examples 1 to 15 and Comparative Examples 1 to 7, and the air gun coating is conducted in Comparative Example 8.

3. Electrostatic coating

The coater to be used is a disc type electrostatic coater, wherein the normal type disc is provided at a position which is slightly higher than that of the golf ball and the paint is sprayed in the downward and diagonal direction.

The conditions to be applied to the golf ball and disc when the golf ball is coated with the paint using the above electrostatic coater will be explained below. It is necessary that these items to be set are described in Tables 1 to 7. However, it is difficult to describe these items precisely and completely in Tables 1 to 7 because of little space and, therefore, they are represented by abbreviations. Abbreviations are shown in parenthesis after the explanation of the respective items.

3-1 Conditions of golf ball

Diameter of the circle wherein the golf ball is moving on its circumference (diameter of circle)

Number of revolutions of the golf ball to be rotated (number of revolutions)

3-2 Conditions of the disc for spraying paint

Number of revolutions of the disc (number of revolutions)

Angle of disc (angle)

Moving position of the disc in the vertical direction (vertical moving position)

Upper limit position when position of golf ball is 0 (Upper)

Lower limit position when position of golf ball is 0 (Lower)

When the upper limit value and the lower limit value are the same, it indicates that the disc is at the rest state without vertical moving.

Voltage to be applied on disc (voltage)

Shape of disc (shape)

I: Normal type disc

Direction for dispersing paint: +50°

The angle of the direction for dispersing paint is 0 in the horizontal direction and (+) in the downward direction.

J: Hat type disc

Direction for dispersing paint: + 15°

K: Well-field type disc

Direction for dispersing paint: −8°

3-3 Other coating conditions

Paint: Two-pack urethane paint is used. Pigments such as titanium oxide are not contained.

Moving speed of golf ball: 5 m/minute

The electroconductivity is imparted in advance to the golf ball before coating by immersing it in a solution obtained by diluting a plastic electroconductive agent NC (trade name) manufactured by Casue Co. with isopropyl alcohol so that the concentration may be 1% by weight and after that, drying it until isopropyl alcohol volatilizing.

The golf ball is coated after placing on three iron needles grounded.

The amount of the paint per one coating is 120 mg.

4. Air gun coating.

Coating is conducted with moving the air gun at a moving speed of 5 m/second within a range of 10 cm (upper direction) and 10 cm (lower direction). In that case, the golf ball is rotated at 200 rpm.

The amount of the paint per one coating is 120 mg.

The respective conditions were set about the above-described items and the paint was coated on the golf ball. The conditions of the golf ball at the time of coating, the conditions of the disc and the coating results are shown in Tables 1 to 7. Further, the results of the coating are evaluated by uniformity of the coating and coating efficiency of the paint. The uniformity of the coating is evaluated by a ratio of the maximum film thickness to the minimum film thickness.

Table 1 illustrates the results of Examples 1 to 3 and Comparative Examples 1 to 2. In Table 1, a difference in results of the coating due to a difference in diameter of the circle (i.e. diameter of circle wherein the golf ball is moving on its circumference) is shown. They are described in the order of increasing diameter of the circle, i.e. Comparative Example 1, Example 1, Example 2, Example 3 and Comparative Example 2 in this order. In Table 2, a difference in results of coating the due to a difference in the number of revolutions of disc at the time of coating is shown. The conditions at the time of coating and the results of the coating are described in the order of increasing number of revolutions of disc, i.e. Comparative Example 4, Example 4, Example 2, Example 5 and Comparative Example 4 in this order.

In Table 3, a difference in results of the coating due to a difference in voltage of the disc at the time of coating is shown. The conditions at the time of the coating and results of the coating are described in the order of increasing voltage of disc, i.e. Comparative Example 5, Example 6, Example 2 and Example 7 in this order.

In Table 4, a difference in results of coating due to difference in angle of disc at the time of coating is shown. The conditions at the time of coating and results of coating are described in the order of increasing angle of disc, i.e. Comparative Example 6, Example 8, Example 2 and Example 9 in this order.

Table 5 illustrates the case when the moving position of the disc in the vertical direction at the time of coating is changed, Table 6 illustrates the case when the shape of the disc and the moving position of the disc in the vertical direction at the time of coating are changed and Table 7 illustrates the case when the position for disposing disc is changed. In Table 7, the results of coating of Comparative Example 8 according to the air gun coating are also shown.

In respective Tables, the arrow (←) of the left direction means that the content are the same as those on the left side. The reason why Example 2 is described in Tables 2, 3, 4 and 7 in addition to Table 1 is as follows. Regarding various conditions defined in the present invention, approximately middle conditions are selected in Example 2 so that it is advantageous to know a change in results of coating caused by a change in various conditions.

The maximum thickness, the minimum thickness, the film thickness ratio and the coating efficiency of the coating described in the respective Tables are determined as follows.

(1) Regarding thickness of coated film

Five dimples of the golf ball are picked up at random.

Regarding the respective dimples, the thickness of the coated film is measured at the respective positions (A, B, C and D) shown in FIG. 1. The average value is determined by adding these values and the average value is taken as a film thickness at the dimple. Then, the maximum thickness and minimum thickness at five dimples are determined, and a ratio of the maximum film thickness part to the minimum film thickness part is determined as a film thickness ratio.

Now referring to FIG. 1, which is a schematic diagram illustrating the surface part of the golf ball, 1 is a dimple and A, B, C and D indicate the following positions, respectively:

A: Center of dimple, i.e. most deep part

B: Edge part of dimple

C: Intermediate part between center and edge part of dimple

D: Surface part of circumference of dimple (2) Coating efficiency

The coating efficiency (R) is determined from an amount of the paint used (amount of paint) and an amount of the paint adhered on the golf ball (coating weight) according to the following equation:

R(%)=[(coating weight)/(amount of paint)]×100.

TABLE 1

| | Comparative Example 1 | Example 1 | Example 2 | Example 3 | Comparative Example 2 |
|---|---|---|---|---|---|
| Golf ball: | | | | | |
| Diameter of circle (m) | 0.4 | 0.6 | 1.0 | 1.4 | 1.6 |
| Number of revolutions (rpm) | 50 | ← | ← | ← | ← |
| Disc: | | | | | |
| Number of revolutions (rpm) | 30,000 | ← | ← | ← | ← |
| Angle (°) | 8 | ← | ← | ← | ← |

TABLE 1-continued

| | Comparative Example 1 | Example 1 | Example 2 | Example 3 | Comparative Example 2 |
|---|---|---|---|---|---|
| Vertical moving position | | | | | |
| Upper (cm) | 6 | ← | ← | ← | ← |
| Lower (cm) | 6 | ← | ← | ← | ← |
| Speed (m/minute) | 0 | ← | ← | ← | ← |
| Voltage (V) | 90,000 | ← | ← | ← | ← |
| Shape | I | ← | ← | ← | ← |
| Results of coating: Coated film | | | | | |
| Maximum thickness (μm) | 20.6 | 19.1 | 18.9 | 19.4 | 21.1 |
| Minimum thickness (μm) | 13.0 | 14.6 | 15.3 | 14.5 | 12.6 |
| Film thickness ratio | 1.58 | 1.31 | 1.24 | 1.34 | 1.67 |
| Paint adhesion efficiency (%) | 38 | 61 | 67 | 58 | 31 |

TABLE 2

| | Comparative Example 3 | Example 4 | Example 2 | Example 5 | Comparative Example 4 |
|---|---|---|---|---|---|
| Golf ball: | | | | | |
| Diameter of circle (m) | 1.0 | ← | ← | ← | ← |
| Number of revolutions (rpm) | 50 | ← | ← | ← | ← |
| Disc: | | | | | |
| Number of revolutions (rpm) | 18,000 | 22,000 | 30,000 | 38,000 | 42,000 |
| Angle (°) | 8 | ← | ← | ← | ← |
| Vertical moving position | | | | | |
| Upper (cm) | 6 | ← | ← | ← | ← |
| Lower (cm) | 6 | ← | ← | ← | ← |
| Speed (m/minute) | 0 | ← | ← | ← | ← |
| Voltage (V) | 90,000 | ← | ← | ← | ← |
| Shape | I | ← | ← | ← | ← |
| Results of coating: Coated film | | | | | |
| Maximum thickness (μm) | 20.7 | 19.6 | 18.9 | 19.5 | 21.3 |
| Minimum thickness (μm) | 12.9 | 14.4 | 15.3 | 14.1 | 11.9 |
| Film thickness ratio | 1.60 | 1.36 | 1.24 | 1.38 | 1.79 |
| Paint adhesion efficiency (%) | 42 | 62 | 67 | 60 | 59 |

TABLE 3

| | Comparative Example 5 | Example 6 | Example 2 | Example 7 |
|---|---|---|---|---|
| Golf ball: | | | | |
| Diameter of circle (m) | 1.0 | ← | ← | ← |
| Number of revolutions (rpm) | 50 | ← | ← | ← |
| Disc: | | | | |
| Number of revolutions (rpm) | 30,000 | ← | ← | ← |

TABLE 3-continued

| | Comparative Example 5 | Example 6 | Example 2 | Example 7 |
|---|---|---|---|---|
| Angle (°) | 8 | ← | ← | ← |
| Vertical moving position | | | | |
| Upper (cm) | 6 | ← | ← | ← |
| Lower (cm) | 6 | ← | ← | ← |
| Speed (m/minute) | 0 | ← | ← | ← |
| Voltage (V) | 45,000 | 70,000 | 90,000 | 120,000 |
| Shape | I | ← | ← | ← |

TABLE 3-continued

| | Comparative Example 5 | Example 6 | Example 2 | Example 7 |
|---|---|---|---|---|
| Results of coating: Coated film | | | | |
| Maximum thickness (μm) | 19.9 | 19.7 | 18.9 | 19.7 |
| Minimum thickness (μm) | 11.7 | 14.7 | 15.3 | 13.2 |
| Film thickness ratio | 1.71 | 1.34 | 1.24 | 1.49 |
| Paint adhesion efficiency (%) | 37 | 56 | 67 | 52 |

TABLE 5-continued

| | Example 10 | Example 11 |
|---|---|---|
| Results of coating: Coated film | | |
| Maximum thickness (μm) | 19.3 | 19.0 |
| Minimum thickness (μm) | 16.5 | 16.9 |
| Film thickness ratio | 1.17 | 1.12 |
| Paint adhesion efficiency (%) | 65 | 67 |

TABLE 4

| | Comparative Example 6 | Example 8 | Example 2 | Example 9 | Comparative Example 7 |
|---|---|---|---|---|---|
| Golf ball: | | | | | |
| Diameter of circle (m) | 1.0 | ← | ← | ← | ← |
| Number of revolutions (rpm) | 50 | ← | ← | ← | ← |
| Disc: | | | | | |
| Number of revolutions (rpm) | 30,000 | ← | ← | ← | ← |
| Angle (°) | 0 | 3 | 8 | 14 | 16 |
| Vertical moving position | | | | | |
| Upper (cm) | 6 | ← | ← | ← | ← |
| Lower (cm) | 6 | ← | ← | ← | ← |
| Speed (m/minute) | 0 | ← | ← | ← | ← |
| Voltage (V) | 90,000 | ← | ← | ← | ← |
| Shape | I | ← | ← | ← | ← |
| Results of coating: Coated film | | | | | |
| Maximum thickness (μm) | 20.3 | 18.9 | 18.9 | 19.5 | 20.6 |
| Minimum thickness (μm) | 13.1 | 13.2 | 15.3 | 13.2 | 12.1 |
| Film thickness ratio | 1.55 | 1.43 | 1.24 | 1.48 | 1.70 |
| Paint adhesion efficiency (%) | 61 | 66 | 67 | 60 | 48 |

TABLE 5

| | Example 10 | Example 11 |
|---|---|---|
| Golf ball: | | |
| Diameter of circle (m) | 1.0 | ← |
| Number of revolutions (rpm) | 50 | ← |
| Disc: | | |
| Number of revolutions (rpm) | 30,000 | ← |
| Angle (°) | 0 | ← |
| Vertical moving position | | |
| Upper (cm) | 18 | 16 |
| Lower (cm) | −2 | 0 |
| Speed (m/minute) | 5 | ← |
| Voltage (V) | 90,000 | ← |
| Shape | I | ← |

TABLE 6

| | Example 11 | Example 12 | Example 13 |
|---|---|---|---|
| Golf ball: | | | |
| Diameter of circle (m) | 1.0 | ← | ← |
| Number of revolutions (rpm) | 50 | ← | ← |
| Disc: | | | |
| Number of revolutions (rpm) | 30,000 | ← | ← |
| Angle (°) | 0 | ← | ← |
| Vertical moving position | | | |
| Upper (cm) | 16 | 14 | 10 |
| Lower (cm) | 0 | −2 | −6 |
| Speed (m/minute) | 5 | ← | ← |
| Voltage (V) | 90,000 | ← | ← |
| Shape | I | J | K |

TABLE 6-continued

| | Example 11 | Example 12 | Example 13 |
|---|---|---|---|
| Results of coating: Coated film | | | |
| Maximum thickness (μm) | 19.0 | 18.8 | 18.7 |
| Minimum thickness (μm) | 16.9 | 16.9 | 17.0 |
| Film thickness ratio | 1.17 | 1.11 | 1.10 |
| Paint adhesion efficiency (%) | 65 | 71 | 72 |

TABLE 7

| | Example 2 | Example 14 | Example 15 | Comparative Example 8 |
|---|---|---|---|---|
| Golf ball: | | | | Air gun |
| Diameter of circle (m) | 1.0 | ← | ← | coating |
| Number of revolutions (rpm) | 50 | ← | ← | |
| Disc: | | | | |
| Number of revolutions (rpm) | 30,000 | ← | ← | |
| Angle (°) | 8 | ← | ← | |
| Vertical moving position | | | | |
| Upper (cm) | 6 | 4 | 0 | |
| Lower (cm) | 6 | 4 | 0 | |
| Speed (m/minute) | 0 | ← | ← | |
| Voltage (V) | 90,000 | ← | ← | |
| Shape | I | J | K | |
| Results of coating: Coated film | | | | |
| Maximum thickness (μm) | 18.9 | 19.4 | 18.9 | 24.6 |
| Minimum thickness (μm) | 15.3 | 15.9 | 15.7 | 10.8 |
| Film thickness ratio | 1.24 | 1.22 | 1.20 | 2.28 |
| Paint adhesion efficiency (%) | 67 | 69 | 71 | 38 |

As is apparent from the results shown in Table 1, regarding Examples 1 to 3 wherein the diameter of the circle (the diameter of the circle wherein the golf ball is moving on its circumference) is within a range of 0.5 to 1.5 m, the film thickness ratio [(maximum film thickness)/(minimum film thickness)] was within a range of 1.5 or less and the uniformity of the coating was high and, at the same time, the coating efficiency was high in comparison with Comparative Examples 1 to 2.

To the contrary, regarding Comparative Example 1 wherein the diameter of the circle is 0.4 m and is smaller than the above range, the film thickness ratio was 1.58 and exceeded 1.5 and the coating efficiency was low such as 38%. Further, regarding Comparative Example 2 wherein the diameter of the circle is 1.6 m and is larger than the above range, the film thickness ratio was large such as 1.67 and the uniformity of the coating was insufficient and, further, the coating efficiency was low such as 31%.

As is apparent from the results shown in Table 2, regarding Example 4, Example 2 and Example 5 wherein the number of revolutions of the disc is within a range of 20,000 to 40,000 rpm, the film thickness ratio was 1.5 or less and the uniformity of the coating is high and, further, the coating efficiency exceeded 60% and was high.

To the contrary, regarding Comparative Example 3 wherein the number of revolutions of the disc is 18,000 rpm and is smaller than the above range, the film thickness ratio was 1.6 and exceeded 1.5. Further, regarding Comparative Example 4 wherein the number of revolutions of the disc is 42,000 rpm and is larger than the above range, the film thickness ratio was 1.79 and exceeded 1.5 and, further, the uniformity of the coating was insufficient.

As is apparent from the results shown in Table 3, regarding Example 6, Example 2 and Example 7 wherein the voltage of the disc is within a range of 60,000 to 130,000 V, the film thickness ratio was 1.5 or less and the uniformity of the coating is high and, further, the coating efficiency was 52% or more and was high.

To the contrary, regarding Comparative Example 5 wherein the voltage of the disc is 45,000 V and is smaller than the above range, the film thickness ratio was 1.7 and exceeded 1.5. Further, the uniformity of the coating was insufficient and the coating efficiency was low such as 37%.

As is apparent from the results shown in Table 4, regarding Example 8, Example 2 and Example 9 wherein the angle of the disc is within a range of 3° to 15°, the film thickness ratio was 1.5 or less and the uniformity of the coating is high and, further, the coating efficiency exceeded 60% and was high.

To the contrary, regarding Comparative Example 6 wherein the angle of the disc is 0° and is smaller than the above range, the film thickness ratio was 1.55 and exceeded 1.5. Further, regarding Comparative Example 7 wherein the angle of the disc is 16° and is larger than the above range, the film thickness ratio was 1.70 and exceeded 1.5 and, further, the uniformity of the coating was insufficient.

As is apparent from the results shown in Tables 5 to 7, regarding Examples 10 to 15, the film thickness ratio was 1.5 or less and the uniformity of the coating is high and, further, the coating efficiency exceeded 65% and was high.

To the contrary, regarding Comparative Example 8 wherein the air gun coating was conducted, the film thickness ratio was 2.26 and exceeded 1.5 and the uniformity of the coating was insufficient.

What is claimed is

1. A method for coating the golf ball, which comprises spraying a paint over the golf ball moving with rotation on the circumference of a circle having a diameter of 0.5 to 1.5 m, from an inclined disc charged with 60,000 to 130,000 V, which is revolving at 20,000 to 40,000 rpm, to coat the golf ball so that a ratio of the maximum film thickness to the minimum film thickness is 1.5 or less after one round of coating.

2. A method for coating a golf ball, which comprises spraying a paint over the golf ball moving with rotation on the circumference of a circle having a diameter of 0.5 to 1.5 m, from a disc charged with 60,000 to 130,000 V, which is revolving at 20,000 to 40,000 rpm and moving in the vertical direction, to coat the golf ball so that a ratio of the maximum film thickness to the minimum film thickness is 1.5 or less after one round of coating.

3. A method for coating a golf ball, which comprises spraying a paint in a downward direction at an angle of 45° or less to the horizontal direction over the golf ball moving with rotation on the circumference of a circle having a diameter of 0.5 to 1.5 m, from a disc charged with 60,000 to 130,000 V, which is revolving at 20,000 to 40,000 rpm, to coat the golf ball so that a ratio of the maximum film thickness to the minimum film thickness is 1.5 or less after one round of coating.

4. The method of coating a golf ball of claim 1, wherein the disc for spraying the paint is rotating at 25,000 to 35,000 rpm.

5. The method of coating a golf ball of claim 1, wherein the charge to be applied to the disc is 80,000 to 100,000 V.

6. The method of coating a golf ball of claim 1, wherein the diameter of the disc is 50 to 150 mm.

7. The method of coating a golf ball of claim 1, wherein the disc is inclined at an angle of 3° to 15° to the horizontal direction.

8. The method of coating a golf ball of claim 3, wherein the paint is sprayed in a downward direction at an angle of 10° to 20° to the horizontal direction.

9. The method of coating a golf ball of claim 1, wherein the paint is sprayed within a range of 45° in the downward direction and 20° in the upward direction.

10. The method of coating a golf ball of claim 1, wherein the golf ball is rotated at 30 to 100 rpm at the time of coating.

11. The method of coating a golf ball of claim 1, wherein the golf ball is coated with a film thickness of 7 to 60 μm.

* * * * *